US010636286B2

(12) United States Patent
Smith et al.

(10) Patent No.: US 10,636,286 B2
(45) Date of Patent: Apr. 28, 2020

(54) SIGNAL RECONSTRUCTION USING RECURSIVE DATA AND SIGNAL RECOVERY USING PREVIOUS KNOWN SIGNALS

(71) Applicant: TYCO SAFETY PRODUCTS CANADA LTD., Concord (CA)

(72) Inventors: Derek C. Smith, Maple (CA); Stephane Foisy, Udora (CA); Pavel Raikhlin, Thornhill (CA); Joshua Gregory Hutchison, North York (CA)

(73) Assignee: TYCO SAFETY PRODUCTS CANADA LTD, Concord, Ontario (CA)

( * ) Notice: Subject to any disclaimer, the term of this patent is extended or adjusted under 35 U.S.C. 154(b) by 87 days.

(21) Appl. No.: 15/587,648

(22) Filed: May 5, 2017

(65) Prior Publication Data

US 2018/0322772 A1 Nov. 8, 2018

(51) Int. Cl.
*G08B 29/18* (2006.01)

(52) U.S. Cl.
CPC ..... *G08B 29/18* (2013.01)

(58) Field of Classification Search
CPC ..... G08B 29/18; G08B 29/10; G08B 29/16; G08B 29/185; G08B 29/186; G08B 29/188; G08B 13/1968; G08B 29/06; G08B 29/123; H03M 13/00; H03M 13/29; H03M 13/31; H03M 13/33; H03M 13/35; H03M 13/37; H03M 13/47; H03L 7/08; H04M 11/04; H04W 24/00; H04W 64/00; H04W 72/1257
USPC ..... 340/506
See application file for complete search history.

(56) References Cited

U.S. PATENT DOCUMENTS 3,353,155 A * 11/1967 Chien ..... H03M 13/19 714/757
4,188,643 A * 2/1980 Schayes ..... H04N 1/419 358/463
4,320,387 A * 3/1982 Powell ..... G04G 21/00 379/93.12
5,272,700 A * 12/1993 Hansen ..... H04L 12/2801 370/480
5,671,278 A * 9/1997 Pires ..... H04N 7/1716 348/E7.056

(Continued)

OTHER PUBLICATIONS

KB6NU, "CW Geeks' Guide to Having Fun with Morse Code: Getting on the Air—Making Contact", Nov. 28, 2014, KB6NU's Ham Radio Blog https/www.kb6nu.com/cw-geeks-guide-to-having-fun-with-morse-code-getting-on-the-air-making-contact/, p. 1-7.*

*Primary Examiner* — Stephen R Burgdorf
(74) *Attorney, Agent, or Firm* — Arent Fox LLP

(57) ABSTRACT

Techniques for decoding communications transmitted by a remote alarm panel over a communications network to a central monitoring station (CMS) are provided. A first signal from the remote alarm panel can be received by the CMS. The CMS can determine that the first signal cannot be decoded due to errors, missing data, or corrupted data in the first signal. The remote alarm panel can retransmit the signal. The CMS can analyze the first and second signals to determine if the first signal can be reconstructed based on information provided by the second signal. The first signal can subsequently be repaired and decoded, allowing the CMS to more quickly respond to the alarm condition provided in the first signal.

17 Claims, 7 Drawing Sheets

(56) References Cited

U.S. PATENT DOCUMENTS

| | | | | |
|---|---|---|---|---|
| 5,896,561 | A * | 4/1999 | Schrader | H04L 1/0025 370/445 |
| 5,909,175 | A * | 6/1999 | Yamasaki | H04J 3/085 340/506 |
| 5,968,197 | A * | 10/1999 | Doiron | H04L 1/188 714/748 |
| 6,577,239 | B2 * | 6/2003 | Jespersen | G08B 13/1418 340/539.11 |
| 6,775,799 | B1 * | 8/2004 | Giorgetta | H03M 13/35 714/704 |
| 6,856,237 | B1 * | 2/2005 | Richmond | G07C 9/00182 340/5.2 |
| 7,480,510 | B1 * | 1/2009 | Woleben | H04L 1/1887 370/230 |
| 8,571,213 | B2 * | 10/2013 | Tran | H04N 21/44236 380/205 |
| 2002/0071421 | A1 * | 6/2002 | Chiu | H04L 1/1809 370/349 |
| 2008/0288986 | A1 * | 11/2008 | Foster | G08B 13/19656 725/62 |
| 2011/0116534 | A1 * | 5/2011 | Seibert | H04L 7/042 375/224 |
| 2011/0286500 | A1 * | 11/2011 | Kim | H04B 7/15 375/211 |
| 2011/0298616 | A1 * | 12/2011 | Foisy | G08B 25/08 340/540 |
| 2012/0129546 | A1 * | 5/2012 | Yang | G01S 5/0252 455/456.1 |
| 2013/0242197 | A1 * | 9/2013 | Inoue | H04N 5/21 348/607 |
| 2014/0094137 | A1 * | 4/2014 | Gregory | H04W 4/90 455/404.2 |
| 2016/0066017 | A1 * | 3/2016 | Kobayashi | H04L 1/00 725/131 |

* cited by examiner

100

SIGNAL RECONSTRUCTION USING RECURSIVE DATA AND SIGNAL RECOVERY USING PREVIOUS KNOWN SIGNALS

FIELD OF THE INVENTION

Embodiments generally relate to the field of remote monitoring systems. More particularly, embodiments relate to techniques for decoding communications transmitted by a remote alarm panel to a central monitoring station (CMS).

DISCUSSION OF RELATED ART

Typical monitoring systems often include a central monitoring station (CMS) connected to multiple alarm panels located at remote premises. The alarm panels may operate according to a variety of different communication protocols to transmit signals to the CMS to indicate a sensed alarm condition at a remote premise. The signals transmitted by a remote alarm panel often traverse a complex and challenging communications network frequently resulting in signal loss at the CMS.

Conventional approaches to addressing signal loss at the CMS typically involve retransmitting the signal repeatedly until an uncorrupted version of the signal is received and can be decoded. These conventional approaches introduce significant delays in response times due to the need to often retransmit the signal numerous times. Further, retransmissions reduce the efficiency of monitoring systems as they occupy resources that could be used to handle other calls from other remote alarm panels.

In view of the foregoing, there is a need for improved techniques to more quickly and efficiently decode communications from a remote alarm panel transmitted over a communications network to a CMS.

SUMMARY OF THE INVENTION

Various embodiments provide techniques for decoding communications transmitted by a remote alarm panel to a central monitoring station (CMS) over a communications network. The decoding techniques can include reconstructing an initial signal using a retransmitted version of the first signal. A first signal from a remote alarm panel can be received by the CMS. The CMS can determine that the first signal cannot be decoded due to errors, missing data, or corrupted data in the first signal. The remote alarm panel can retransmit the signal. The CMS can analyze the first and second signals to determine if the first signal can be reconstructed based on information provided by the second signal. The first signal can subsequently be repaired and decoded, allowing the CMS to more quickly respond to the alarm condition provided in the first signal.

Various embodiments provide for recovering received data or information in a signal based on previously received data or information. Data or information from a remote alarm panel can be received by the CMS. The CMS can identify the remote alarm panel based on information related to the received signal. When the CMS determines that the data or information cannot be decoded due to errors, missing data, or corrupted data in the signal, the data or information can be compared to a number of stored data or information to determine a match between the stored data or information and the received data or information. The received data or information can subsequently be recovered and decoded, allowing the CMS to more quickly respond to the alarm condition provided in the received data. Other embodiments are disclosed and described.

DESCRIPTION OF EMBODIMENTS

Figure 1:
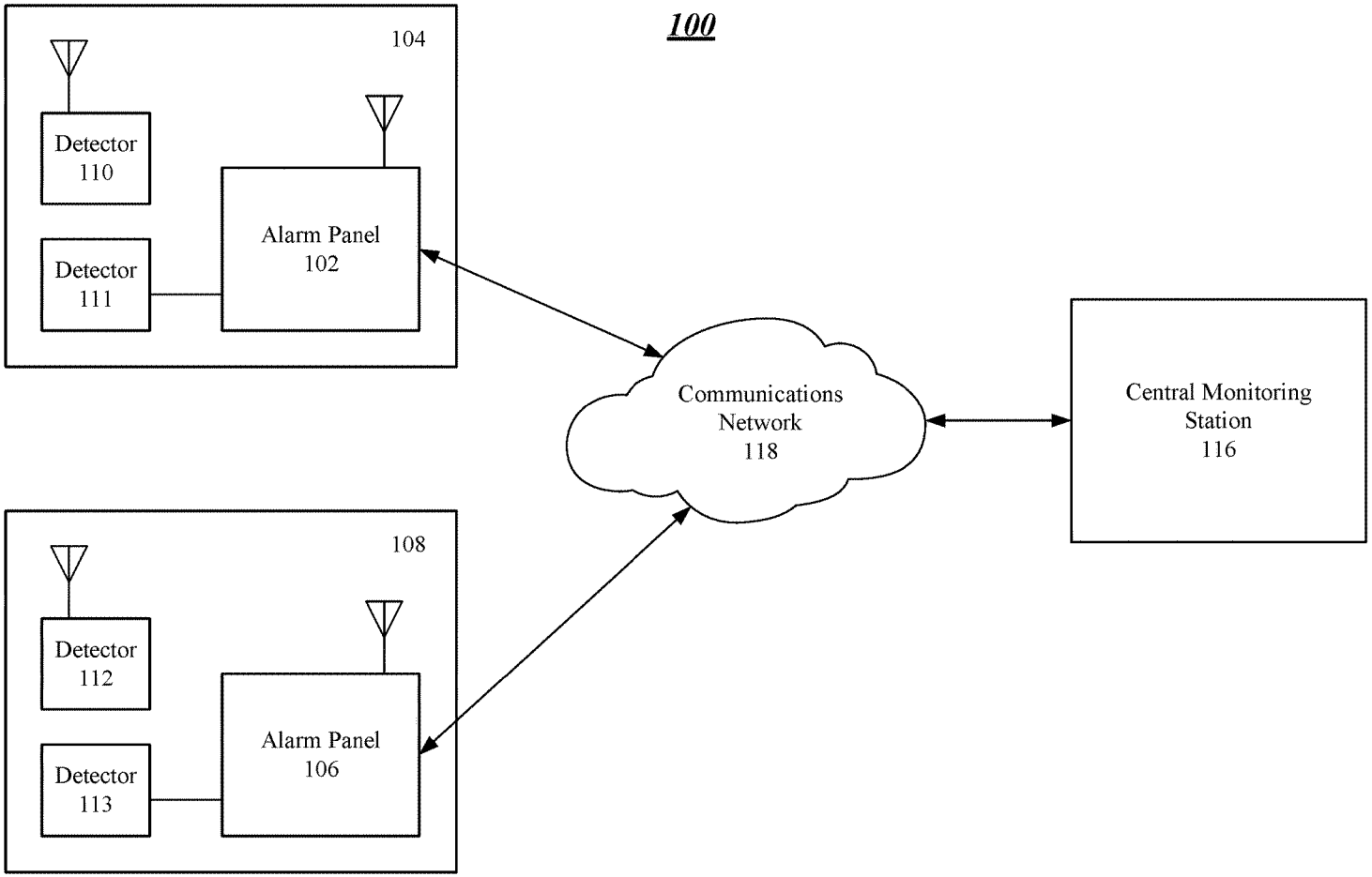
FIG. 1 illustrates an exemplary embodiment of a monitoring system.

The present invention will now be described more fully hereinafter with reference to the accompanying drawings, in which preferred embodiments of the invention are shown. It will be appreciated, however, that the invention may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

FIG. 1 illustrates an exemplary embodiment of a monitoring system 100. The monitoring system 100 can be, for example, a security system and/or an environmental monitoring system. The monitoring system 100 includes a first alarm panel 102 located at a first customer premise 104 and a second alarm panel 106 located at a second customer premise 108. The first and second customer premises 104 and 108 may be residential or business premises.

The first alarm panel 102 is connected to the detector 110 and the detector 111 via a wired or a wireless connection. For example, the detector 110 can be connected to the first alarm panel 102 over a wireless connection while the detector 111 can be connected to the first alarm panel 102 over a wired connection. Similarly, the second alarm panel 106 is connected to the detector 112 and the detector 113 via a wired or a wireless connection. For example, the detector 112 can be connected to the second alarm panel 106 over a wireless connection while the detector 113 can be connected to the second alarm panel 106 over a wired connection.

The detectors 110-113 provide information regarding a status of a monitored space such as, for example, environmental and/or security monitoring of a space. For example, the detectors 110-113 can be motion detectors, glass break detectors, or contact detectors. The detectors 110-113 may also be environmental detectors including, for example, temperature detectors, smoke detectors, or gas detectors. The alarm panels 102 and 106 are each shown connected to two detectors but are not so limited. That is, the first alarm panel 102 may be connected to any number of detectors located at the first customer premise 104 and the second alarm panel 106 can be connected to any number of detectors located at the second customer premise 108. The alarm panels 102 and 106 can typically include user input and/or output devices (e.g., a keypad or a display) as well as notification systems (e.g., audible and/or visual alarms).

The alarm panels 102 and 106 can be connected to a central monitoring station (CMS) 116 over a communications network 118. The communications network 118 can include a variety of digital and analog networks that operate according to a variety of communication protocols. The communications network 118 can include portions of the public switched telephone network (PSTN) and/or portions of a cellular or other wireless network. The communications network 118 can include a variety of communication links (e.g., fiber optic lines and/or T1 lines) that may involve conversions of data across different data formats including voice-over-internet protocol (VoIP) communications, analog-to-digital (A/D) conversions, and packet based routing or circuit based switching.

The CMS 116 can be located remotely from the alarm panels 102 and 106 and connected to the communications network 118 to facilitate bilateral communication with the alarm panels 102 and 106. The CMS 116 is shown connected to two alarm panels but is not so limited. That is, the CMS 116 can be connected to any number of remote alarm panels. The monitoring system 100 operates to relay information about a monitored space from one of the detectors 110-113 to the CMS 116. Specifically, the detector 110 can detect a condition of a space monitored by the detector 110. The detector 110 can provide information regarding the detected condition to the first alarm panel 102 as an alarm condition. An example of a detected condition can be smoke within a monitored space. The first alarm panel 102 can communicate with the CMS 116 over the communications network 118 to report the alarm condition.

The alarm panel 102 can initiate communications with the CMS 116 by, for example, dialing a telephone number associated with the CMS 116. Once a telephone connection is established between the alarm panel 102 and the CMS 116, the alarm panel 102 can generate and send data over the communications network 118 to the CMS 116 representative of the sensed alarm condition or event. The CMS 116 can receive and process the data sent by the alarm panel 102. Based on the sensed alarm condition, the CMS 116 can choose an appropriate action or response (e.g., contacting fire department, notifying an owner of the premise 104, etc.).

The alarm panels 102 and 106 can be different types of alarm panels produced by different manufacturers. Further, the alarm panels 102 and 106 may operate differently to generate and transmit data over the communications network 118 to the CMS 116. The alarm panels 102 and 106 may operate according to different communication protocols such as, for example, dual-tone multi-frequency (DTMF) or any other data modulation or coding protocol using one or more carrier signals. Accordingly, the CMS 116, when connected to a very large number of alarm panels, may be required to receive and process data signals that can be formatted according to one of a relatively large number of different communication protocols. Further, the quality and integrity of the data signals received by the CMS 116 can suffer due to complexities of the communications network 118.

The changing and complex signal paths of the data signals sent by the alarm panels 102 and 106 as they travel over the communications network 118 can result in signal loss at the CMS 116. Signal loss at the CMS 116 can cause slower response times to alarm conditions, missed signals, and additional costs for original signals to be re-attempted and retransmitted.

Conventional approaches to handling signal loss at the CMS 116 rely on the stability of connections over the communications network 118 and re-try mechanisms that may be built in to the signaling protocol used for transmitting data signals (e.g., checksums, signal retransmissions if an acknowledgement of signal receipt is not received, etc.). These conventional approaches, however, are not available for all communication formats and protocols. Further, re-sending a data signal can introduce significant delays in response times. Lastly, reliability issues associated with the communications network 118 may persist for long periods of time, making multiple retransmission attempts necessary or even ineffective against challenging communication conditions.

Figure 2:
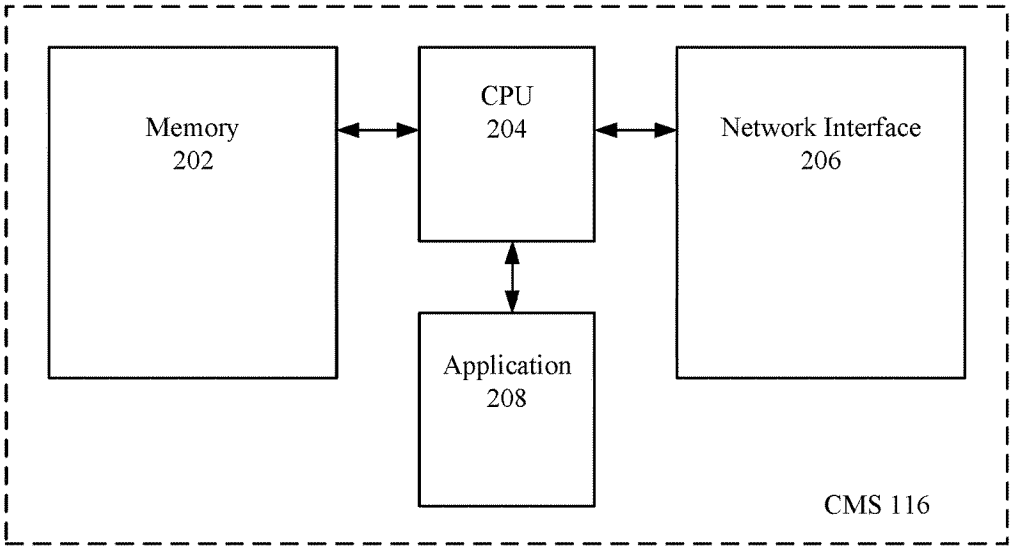
FIG. 2 illustrates an exemplary embodiment of the central monitoring station (CMS) depicted in FIG. 1.

FIG. 2 illustrates an exemplary embodiment of the CMS 116 depicted in FIG. 1. As shown in FIG. 2, the CMS 116 can include a memory component 202, a central processing unit (CPU) component or a processor component 204, a network interface component 206, and an application component 208. The processor 204 operates as a controller for the CMS 116 and is communicatively coupled to the memory 202 and the network interface 206 and can control overall operation of the memory 202 and the network interface 206. The memory 202 can store operational parameters for the CMS 116 as well as information regarding the first and second alarm panels 102 and 106. The network interface 206 interfaces with the communications network 118 to transmit and receive signals to and from the alarm panels 102 and 106. The application 208 can be computer code or instructions (e.g., non-transitory machine-readable instructions stored in the memory 202 or other storage medium) operative on the processor 204. The application 208 can direct operation of the CMS 116 to receive and process data signals to determine a sensed alarm condition reported by the alarm panel 102 or the alarm panel 106.

Generally, the CMS 116 operates to communicate with the first and second alarm panels 102 and 106 to send and receive data. In particular, the CMS 116 operates to process data from the alarm panels 102 and 106 including decoding data representative of a sensed alarm condition and determining an appropriate response thereto. The CMS 116 receives data signals from the alarm panels 102 and 106 over telephone lines. The data signals can be of a variety of forms including, for example, amplitude modulated (AM) data, quadrature amplitude modulated data signals (QAM), frequency shift keyed signals (FSK), phase shift keyed signals (PSK), and DTMF modulated data signals. The data signals can be formatted to include one or bits of data and/or packets of data. The data signals can be indicative of the sensed alarm condition and can be encoded. The CMS 116 can decode the data signals to determine the reported alarm condition. After decoding a received data signal, the CMS 116 can determine an appropriate response for the reported alarm condition and can provide an indication to the transmitting alarm panel that communications are established or have been successful. The indication can be in the form of a transmitted acknowledgement signal from the CMS 116 to the transmitting alarm panel, which can be referred to as a kiss-off.

To address signal loss, the CMS 116 can operate to reconstruct a data signal using recursive data when the initial data signal cannot be correctly decoded on its own. The CMS 116 can receive a first or initial signal from one of the remote alarm panels (e.g., the alarm panel 102). If the initial signal from the alarm panel 102 can be correctly decoded, then the CMS 116 can transmit an acknowledgement reply signal to the alarm panel 102. If the initial signal cannot be correctly decoded, then the CMS 116 can determine that an acknowledgement is not to be transmitted. The CMS 116 can store the initial signal. When the alarm panel 102 retransmits the signal (e.g., a second or subsequent signal), the CMS 116 can attempt to recover or reconstruct the first signal by comparing the subsequent signal with the previously received signal. In particular, the initial corrupted signal can be repaired or recovered based on the second signal. The alarm panel 102 can transmit the second signal during a same call to the CMS 116 during which the initial signal is transmitted.

If the subsequent signal is received with no errors, then the CMS 116 can simply decode the data signal as intended and can send an acknowledgement indicating successful reception. However, if the second signal also contains errors (e.g., the signal is corrupted or includes errors) and cannot be correctly decoded on its own, then the CMS 116 can make a comparison of the previous failed signal and the newly received signal to attempt to form a repaired signal that can be successfully decoded. The CMS 116 can then make a determination as to what sensed alarm condition or communication was provided by the alarm panel 102 and can transmit an acknowledgement signal to the alarm panel 102. This process can be applied to any number of subsequently retransmitted signals until the initially transmitted signal is correctly decoded after being reliably reconstructed using one or more subsequently transmitted signals.

Figure 3:
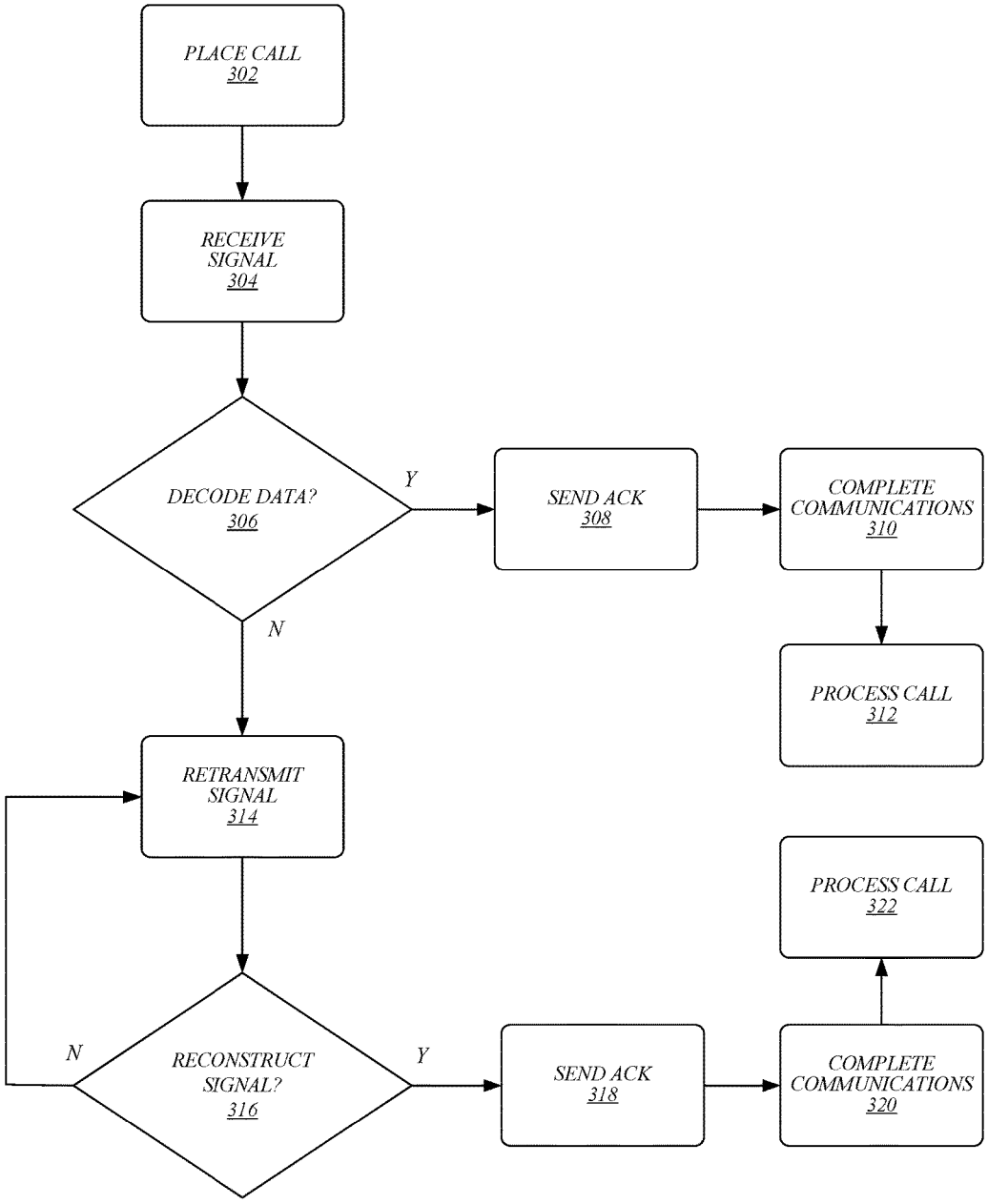
FIG. 3 illustrates a first logic flow.

FIG. 3 illustrates a logic flow 300 for decoding communications between an alarm panel (e.g., the first alarm panel 102) and a CMS (e.g., the CMS 116). The logic flow 300 may be representative of operations executed by the alarm panel 102 and/or the CMS 116 to reconstruct signals using subsequently received signals. At 302, the alarm panel 102 contacts the CMS 116 by sending a signal over the communications network 118. As an example, the alarm panel 102 can contact CMS 116 by placing a call over a telephone line using a telephone number associated with the CMS 116.

At 304, the CMS 116 receives the signal from the alarm panel 102. As an example, the CMS 116 can receive an incoming call over a telephone line from the alarm panel 102. During the call, the CMS 116 can receive the signal transmitted by the alarm panel 102.

At 306, the CMS 116 attempts to decode the data provided in the signal received from the alarm panel. If the signal received from the alarm panel 102 can be correctly decoded, then the CMS 116 can consider the call from the alarm panel 102 to be a good call. The CMS 116 can then send an acknowledgement signal at 308 to the alarm panel 102 (shown as "ACK" in FIG. 3) indicating a successful decoding of the signal. The CMS 116 can then complete event communications with the alarm panel 102 at 310 based on the successful decoding of the signal transmitted by the alarm panel 102. At 312, the CMS 116 can further process the call from the alarm panel 102 by responding to the decoded signal. Specifically, at 312, the CMS 116 can initiate a response to the decoded signal from the alarm panel 102 indicating a sensed alarm condition or other communication.

If the signal received from the alarm panel 102 cannot be correctly decoded, then the CMS 116 considers the call from the alarm panel 102 to be a failed call. Consequently, the CMS 116 can determine to not transmit an acknowledgement signal to the alarm panel 102. At 314, the alarm panel 102 retransmits the signal to the CMS 116. The alarm panel 102 can determine to transmit the same signal again based upon not receiving an acknowledgement signal from the CMS 116. The alarm panel 102 can transmit the signal again on the same call placed to the CMS 116. That is, both the first and second signals transmitted by the alarm panel 102 can be provided over the same call to the CMS 116. The CMS 116 can receive the retransmitted signal at 314.

At 316, the CMS 116 attempts to reconstruct the first signal using information from the retransmitted signal. Specifically, the CMS 116 compares the initial signal and the retransmitted signal in an attempt to reconstruct the initial signal that could not be correctly decoded on its own. If the initial signal can be reconstructed, then at 316 the CMS 116 generates and/or outputs a repaired signal and proceeds to 318. At 318, the CMS 116 generates and transmits an acknowledgement signal to the alarm panel 102. The CMS 116 can then complete event communications with the alarm panel 102 at 320 based on the successful decoding of the reconstructed and/or repaired signals from the alarm panel 102. At 322, the CMS 116 further processes the call from the alarm panel 102 by responding to the decoded repaired signal. Specifically, at 322, the CMS 116 initiates a response to the decoded repaired signal from the alarm panel 102 indicating a sensed alarm condition or other communication.

As shown in FIG. 3, if the retransmitted signal from the alarm panel 102 cannot be used to successfully reconstruct the initial data signal at 316, then the logic flow 300 can return to 314 and another retransmitted signal can be provided. Any number of retransmitted signals can be provided and used in an attempt to reconstruct and/or repair the initial signal from the alarm panel 102. The retransmitted signals can be transmitted during the same call to the CMS 116. Further, if any of the retransmitted signals can be successfully decoded on its own, then the CMS 116 can process the retransmitted signal on its own without any need to attempt to reconstruct and/or repair the initial signal.

Figure 4:
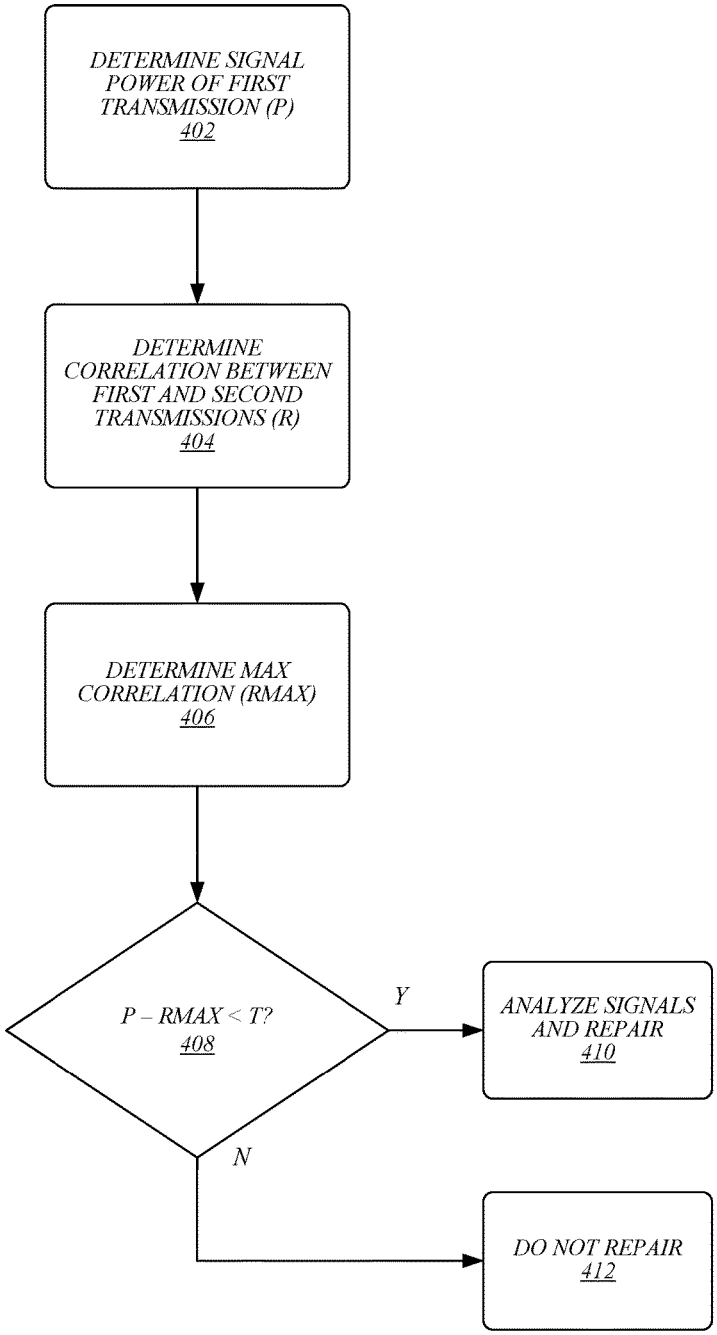
FIG. 4 illustrates a second logic flow.

FIG. 4 illustrates a logic flow 400 for recovering communications between an alarm panel (e.g., the alarm panel 102) and a CMS (e.g., the CMS 116). The logic flow 400 may be representative of the operations executed by the CMS 116 after receiving a first signal that cannot be decoded and after receiving a second retransmitted signal. At 402, a signal power of the first received transmission/signal can be determined (shown in FIG. 4 as "P"). The first signal can be stored in a memory of the CMS 116 (e.g., in a first buffer of memory 202).

At 404, a correlation function between the first and second signals can be determined (shown in FIG. 4 as "R"). The second signal can also be stored in a memory of the CMS 116 (e.g., in a second buffer of the memory 202). The first and second signals can be stored in first and second buffer memories, respectively, during the same call from the alarm panel 102 to the CMS 116. At 406, a maximum value of the correlation function between the first and second signals can be determined (shown in FIG. 4 as "RMAX"). As an example, the maximum correlation value can be determined by shifting the contents of a first buffer storing the first signal and comparing the first signal to the second signal stored in a second buffer.

At 408, a difference between the signal power of the first signal and the maximum value of the correlation function can be compared to a threshold. The threshold can be predetermined and can be stored in the memory 202 of the CMS 116. The threshold can be adjusted or varied for a particular alarm panel and/or a particular type of communication format or protocol used by an alarm panel. If the difference between the signal power of the first signal and the maximum value of the correlation function is less than the threshold, then it can be determined that the first and second signals are relatively similar and can be used to reconstruct the first signal. Accordingly, at 410 the CMS 116 can analyze the first and second signals to reconstruct the first signal using information from the second data signal (e.g., the shape of the second signal).

Alternatively, if the difference between the signal power of the first signal and the maximum value of the correlation function is greater than the threshold, then it can be determined that the first and second signals are relatively dissimilar and cannot be used to reconstruct the first signal. For example, the alarm panel 102 may have sent a first signal of a first type and a second different signal of a different type (e.g., two signals carrying different information instead of the same information and/or two signals having different shapes). Accordingly, at 412 the CMS 116 can determine that the first signal cannot be reconstructed using the second signal. The CMS 116 can then attempt to reconstruct the first signal based on a further retransmitted signal provided by the remote alarm panel 102. The further retransmitted signal provided by the remote alarm panel 102 can also be provided during the same call to the CMS 116.

Once a signal is reconstructed using a subsequently transmitted signal, the CMS 116 can verify that the reconstructed signals is corrected. For example, the cyclic redundancy check (CRC) or checksum of the signal can be verified to ensure the reconstructed signal is correctly repaired.

Figure 5:
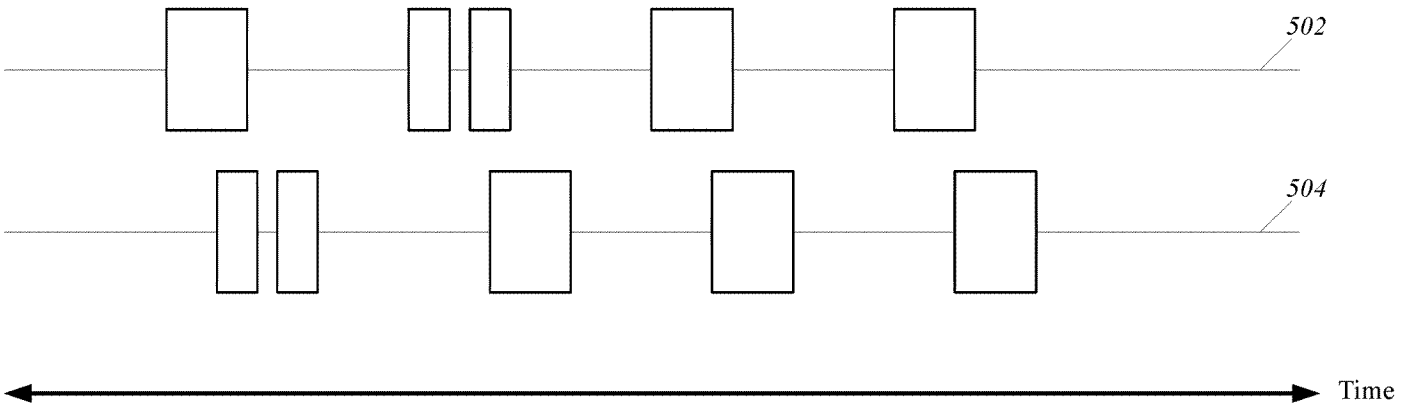
FIG. 5 illustrates exemplary first and second data signals received by the CMS depicted in FIGS. 1 and 2.

FIG. 5 illustrates an exemplary first signal transmission 502 and an exemplary second signal transmission 504 that can be sent by the remote alarm panel 102 and received by the CMS 116. The first signal transmission 502 can include a number of pulses or packets as shown. That is, the first signal transmission 502 can have a first shape as shown. Likewise, the second signal transmission 504 can include a number of pulses or packets as shown and can have a second shape. The first signal transmission 502 can be stored in a first buffer in the memory 202 of the CMS 116. The second signal transmission 504 can be stored in a second buffer in the memory 202 of the CMS 116. The first and second signal transmission 502 and 504 can be transmitted and received during the same call to the CMS 116. The first and second signals 502 and 504 can represent first and second signals that are compared using a correlation function—for example, as depicted at 404 in FIG. 4. The correlation function comparison can involve time shifting either of the first and second signal transmissions 502 and 504 in either direction (e.g., left or right) relative to a time reference.

Figure 6:
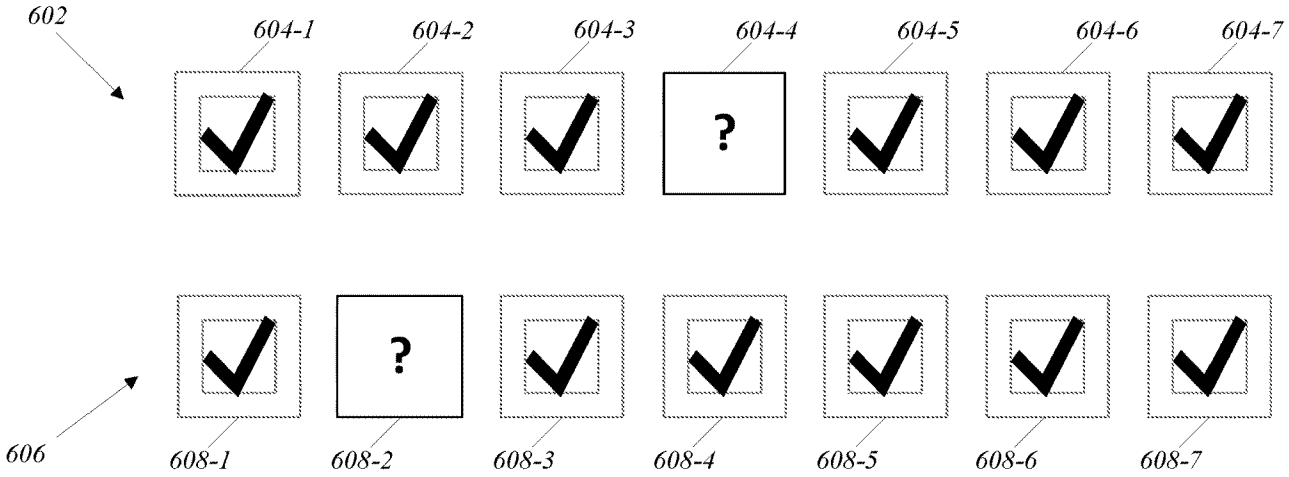
FIG. 6 illustrates reconstruction of a first data signal using a second retransmitted signal.

FIG. 6 illustrates an exemplary technique for reconstructing a first data signal 602 using a second signal 604. The first data signal 602 can represent a first transmission from the alarm panel 102 and received by the CMS 116. The second data signal 606 can represent a second transmission from the alarm panel 102 and received by the CMS 116.

As shown, the first data signal 602 can include seven packets 604-1 through 604-7. All packets other than packet 604-4 can be successfully decoded or determined by the CMS 116. As an example, all packets other than packet 604-4 can include data while packet 604-4 can include corrupted data or missing data. Since packet 604-4 cannot be decoded or determined, the CMS 116 can determine that the first data signal 602 overall cannot be decoded or determined.

The second signal 606 can also include seven packets 608-1 through 608-7. The second signal 606 can represent a retransmission of the first data signal 602. Specifically, the packets 608-1 through 680-7 of the second data signal 606 can include the same data or information as the corresponding packets 604-1 through 604-7 of the first data signal when prepared and transmitted by the alarm panel 102. At the CMS 116, the second data signal 606 can be analyzed to determine that all packets other than packet 608-2 can be decoded or determined. As such, the CMS 116 can determine that the second data signal, like the first data signal 602, cannot be fully decoded or determined on its own.

To reconstruct or repair the first data signal 602, the CMS 116 can determine that the first and second data signals 602 and 606 are relatively similar signals (e.g., by implementing the logic flow 400 depicted in FIG. 4). The CMS 116 can then compare the packets 604-1 through 604-7 to the packets 608-1 through 608-7. In doing so, the CMS 116 can determine a value, data, or decoding of the packet 604-4 using the information from the packet 608-4 from the second data signal 606. Accordingly, the first data signal 602 can be fully reconstructed or repaired using the second data signal 606. The CMS 116 can subsequently fully decode the reconstructed first data signal 602 to determine the sensed alarm condition transmitted by the alarm panel 102.

As another technique to address signal loss, the CMS 116 can also operate to recover data in a signal using prior received data when the initial data within a signal cannot be correctly decoded. The CMS 116 can receive and store previously received data from signals that were successfully decoded. Over time, the CMS 116 can develop a library of known data and/or signals from a particular alarm panel (e.g., the alarm panel 102). The CMS 116 can then use the known data to compare to data from a signal that cannot be decoded. As an example, the CMS 116 can attempt to "pattern match" the data that cannot be decoded to a set of known data from signals that were correctly decoded to determine if any of the stored data matches or approximately matches the data that cannot be decoded. If a match or an approximate match is determined, then the CMS 116 can recover the data that cannot be decoded on its own by determining that the "matched" data was received.

A library of correctly received data or information can be stored in the memory 202 of the CMS 116. When a data signal received by the CMS 116 cannot be decoded correctly on its own, the library of data stored in the memory 202 can be used to attempt to recover the missing or corrupted data of the erroneous signal. As described, the CMS can attempt to match the received erroneous data with data previously stored in the memory 202.

As an example, the CMS 116 can receive a data signal that cannot be decoded (e.g., an erroneous signal). The erroneous signal can include a number of packets. If one of the packets is dropped, then the signal can be missing data in the position of the dropped packet. The erroneous data can be superimposed over one or more known data sequences to line up and determine where the erroneous data matches up with one of the known data sequences to build a "good signal." This approach allows for a signal to be correctly received and decoded without adding significant delay to the response time of the event as no signal retransmission is necessary.

Figure 7:
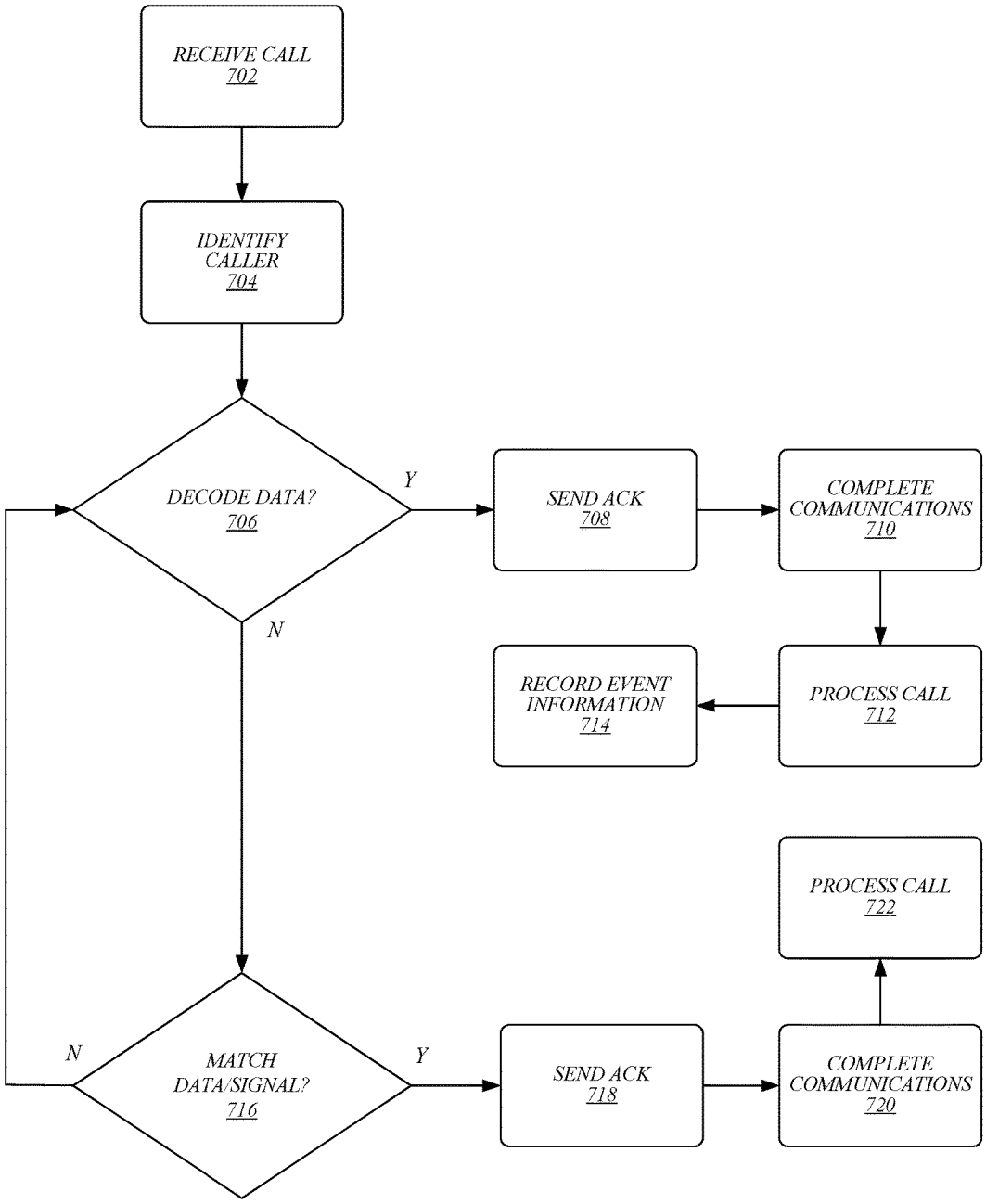
FIG. 7 illustrates a third logic flow.

FIG. 7 illustrates a logic flow 700 for decoding communications between an alarm panel (e.g., the first alarm panel 102) and a CMS (e.g., the CMS 116). The logic flow 700 may be representative of operations executed by the alarm panel 102 and/or the CMS 116 to recover data using data previously stored.

At 702, the alarm panel 102 contacts the CMS 116. The alarm panel 102 can contact the CMS 116 by sending a signal over the communications network 118. As an example, the alarm panel 102 can contact the CMS 116 by placing a call over a telephone line using a telephone number associated with the CMS 116. The signal can include data or information for decoding.

At 704, the CMS 116 receives the signal from the alarm panel 102. As an example, the CMS 116 can receive an incoming call over a telephone line from the alarm panel 102. At 704, the CMS 116 can determine caller information based on the received call. Specifically, the CMS 116 can determine which particular remote alarm panel placed the call to the CMS 116. The identity of the alarm panel 102 can be determined, for example, based on caller identification (ID) information, automatic number identification (ANI) information, or dialed number identification service (DNIS) provided as part of the call or signal. The identity of the alarm panel 102 can also be determined based on a particular time or time period (e.g., predetermined time period) when the signal from the alarm panel 102 is received. That is, the alarm panel 102 may routinely transmit a signal to the CMS 116 at approximately the same time every day (e.g., with the same alarm condition or check-in information). Accordingly, the CMS 116 can use this information (e.g., time or receipt of signal and/or type of check-in information provided) to determine which alarm panel has placed a call to the CMS 116.

At 706, the CMS 116 attempts to decode the data provided in the signal received from the alarm panel. If the data received from the alarm panel 102 can be correctly decoded, then the CMS 116 can consider the call from the alarm panel 102 to be a good call. The CMS 116 can then send or transmit an acknowledgement signal at 708 to the alarm panel 102 (shown as "ACK" in FIG. 7) indicating a successful decoding of the data in the signal. The CMS 116 can then complete event communications with the alarm panel 102 at 710 based on the successful decoding of the data or information transmitted by the alarm panel 102. At 712, the CMS 116 can respond to the decoded data by further processing the call from the alarm panel 102. Specifically, at 712, the CMS 116 can initiate a response to the decoded data from the alarm panel 102 indicating a sensed alarm condition or other communication.

At 714, the CMS 116 can store information related to the call from the alarm panel and the processing of the call by the CMS 116. For example, information such as the identity of the alarm panel 102, the signal transmitted by the alarm panel 102, the data included in the signal, the sensed alarm condition or other communication provided by the alarm panel 102, and the type and formatting of the data and/or signal from the alarm panel 102 can be stored by the CMS 116. This information can be used to help decode later transmitted data from the alarm panel 102.

If the data or information received from the alarm panel cannot be correctly decoded, then the CMS 116 can consider the call from the alarm panel 102 to be a failed call. Consequently, the CMS 116 can determine to not transmit an acknowledgement signal to the alarm panel 102.

At 716, the CMS 116 can attempt to decode the received data or information from the alarm panel 102 by comparing the received data or information to data or information stored in the memory 202 of the CMS 116. The CMS 116 can compare the data from the alarm panel 102 to stored data that was previously received from the alarm panel 102. The stored data can include data from the alarm panel 102 that was previously correctly decoded at the CMS 116. The CMS 116 can attempt to recover or repair any missing or corrupted data by matching the received data and/or signal from the alarm panel 102 with data stored in the memory 202. As a result of this recovery operation, the CMS 116 can repair the data from the alarm panel 102, identify matching stored data in the memory 202, or determine that the data from the alarm panel cannot be recovered and/or does not have a match and therefore cannot be decoded.

If the data received form the alarm panel 102 cannot be decoded after the matching operation of 716, then the CMS 116 can wait for the alarm panel 102 to retransmit the data again to the CMS 116. The alarm panel 102 can determine to transmit the same data again based upon not receiving an acknowledgement signal from the CMS 116. The CMS 116 can receive the retransmitted data and can attempt to decode the retransmitted data at 706. The CMS 116 can verify based on caller identification information that the retransmitted data signal is from the same alarm panel 102.

If the initial data can be recovered, then at 716 the CMS 116 can generate and/or output recovered data and can proceed to 718. At 718, the CMS 116 can generate and transmit an acknowledgement signal to the alarm panel 102. The CMS 116 can then complete event communications with the alarm panel 102 at 720 based on the successful decoding of the reconstructed and/or repaired data signal from the alarm panel 102. At 722, the CMS 116 can further process the call from the alarm panel 102 by responding to the decoded recovered data. Specifically, at 722, the CMS 116 can initiate a response to the decoded recovered data from the alarm panel 102 indicating a sensed alarm condition or other communication.

As shown in FIG. 7, if a corrupt or otherwise erroneous data or information from the alarm panel 102 cannot be recovered at 716—either initial data from the alarm panel 102 or retransmitted data—then the logic flow 700 can return to 706 and a next retransmitted data signal can be provided. Any number of retransmitted data signals can be provided and used in an attempt to reconstruct and/or repair the initial data from the alarm panel 102. Further, if any of the retransmitted data can be successfully decoded on its own, then the CMS 116 can process the retransmitted data on its own without any need to attempt to reconstruct and/or repair the initial data.

The CMS 116 can create a profile for each alarm panel remotely coupled to the CMS 116. For example, the CMS 116 can generate a library of previously received and successfully decoded data from each alarm panel, with the signals for a particular alarm panel identified based on caller ID information or time of day information as described above. In various embodiments, the CMS 116 and a particular alarm panel (e.g., the alarm panel 102) can initiate an automatic learning process. Specifically, the alarm panel 102 can transmit all possible data to the CMS 116. The CMS 116 can store the received data to build a library of data received from the alarm panel 102. The library of data can then be used by the CMS 116 for reconstructing data from the alarm panel 102 and/or matching data or signals from the alarm panel 102 with data from the constructed data library.

In various embodiments, the logic flow 400 can be implemented by the CMS 116 to compare data from an alarm panel to stored previously received data from the alarm panel to determine if the data from the alarm panel can be reconstructed or may match one of the stored data. That is, the logic flow 400 can be implemented to determine if erroneous or corrupted data from an alarm panel can be reconstructed from a previously known data stored by the CMS 116, or if a data match can be identified as a correct or uncorrupted version of the erroneous data.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A method for decoding communications between a remote alarm panel and a central monitoring station over a communications network, comprising:

receiving a first signal from the remote alarm panel;

determining that the first signal cannot be decoded and that an acknowledgment signal is not to be transmitted;

receiving a second signal from the remote alarm panel on a same call as the first signal;

determining a correlation function between the first signal and the second signal, including shifting contents of a first buffer storing the first signal and comparing the shifted first buffer to a second buffer storing the second signal;

determining a signal power of the first signal;

determining, based on the correlation function and the signal power of the first signal, that the first signal can be reconstructed based on the second signal;

reconstructing the first signal using the second signal; and decoding the reconstructed first signal.

2. The method of claim 1, further comprising receiving the first signal and the second signal on the same call from the remote alarm panel to the central monitoring station.

3. The method of claim 2, further comprising storing the first signal in a first buffer memory and storing the second signal in a second buffer memory.

4. The method of claim 1, further comprising transmitting an acknowledgement signal to the remote alarm panel after decoding the reconstructed first signal.

5. The method of claim 1, wherein determining the correlation function between the first signal and the second signal further comprises determining a maximum correlation value of the correlation function.

6. The method of claim 5, wherein determining that the first signal can be reconstructed based on the second signal comprises comparing a difference between a value representing the signal power of the first signal and the maximum correlation value of the correlation function to a threshold value.

7. The method of claim 6, further comprising repairing the first signal using the second signal when the difference between the value representing the signal power of the first signal and the maximum correlation value of the correlation function is less than the threshold value.

8. The method of claim 6, wherein the threshold value is based on a format of the first signal.

9. The method of claim 1, further comprising verifying the reconstructed first signal based on a cyclic redundancy check or a checksum.

10. A component for decoding communications from a remote alarm panel over a communications network, comprising:

a network interface for receiving signals having recursive data from the remote alarm panel and sending further signals to the remote alarm panel over the communications network;

an application operative on a processor component and communicatively coupled with the network interface; and a memory operative to store the received signals from the remote alarm panel;

the application operative to:

receive a first signal from the remote alarm panel;

determine that the first signal cannot be decoded and that an acknowledgement signal is not to be transmitted;

receive a second signal from the remote alarm panel;

determine a correlation function between the first signal and the second signal, including shifting contents of a first buffer storing the first signal and comparing the shifted first buffer to a second buffer storing the second signal;

determine a signal power of the first signal;

use the correlation function and the signal power of the first signal to determine that the first signal can be reconstructed based on the second signal;

reconstruct the first signal using the second signal; and decode the reconstructed first signal.

11. The component of claim 10, wherein the application is further operative to receive the first signal and the second signal on a same call from the remote alarm panel to the component.

12. The component of claim 10, wherein the application is further operative to determine a maximum correlation value of the correlation function between the first signal and the second signal.

13. The component of claim 12, wherein the application is further operative to compare a difference between a value representing the signal power of the first signal and the maximum correlation value of the correlation function to a threshold value to determine whether the first signal can be reconstructed from the second signal.

14. A method for decoding communications between a remote alarm panel and a central monitoring station over a communications network, comprising:

receiving a first signal from the remote alarm panel;

identifying the remote alarm panel based on the first signal;

determining that the first signal received from the panel cannot be decoded;

comparing the first signal to a plurality of stored data associated with the remote alarm panel to match the first signal to a second signal in the plurality of stored data, the plurality of stored data comprising a set of known data from correctly decoded signals;

determining a correlation function between the first signal and the second signal, including shifting contents of a first buffer storing the first signal and comparing the shifted first buffer to a second buffer storing the second signal;

determining a signal power of the first signal;

determining, based on the correlation function and the signal power of the first signal, that the first signal can be reconstructed based on the second signal; and reconstructing the first signal using the second signal.

15. The method of claim 14, further comprising identifying the remote alarm panel based on at least one of caller identification (ID) information, automatic number identification (ANI) information, a dialed number identification service (DNIS) information, and a predetermined time period.

16. The method of claim 14, further comprising superimposing the first signal over the plurality of stored data to identify the one of the second signal in the plurality of stored data that matches the first signal.

17. The method of claim 14, the plurality of stored data including data previously transmitted by the remote alarm panel.

* * * * *